United States Patent [19]

Liljegren et al.

[11] Patent Number: 4,815,526

[45] Date of Patent: Mar. 28, 1989

[54] CENTRAL SPACE HEATING APPARATUS

[75] Inventors: Leif Liljegren, 550 Ramapo Valley Rd., Oakland, N.J. 07436; Harry J. Scanlan, 8360 Greensboro Dr., McLean, Va. 22102

[73] Assignees: Leif Liljegren; Harry J. Scanlan, ; a part interest

[21] Appl. No.: 199,104

[22] Filed: May 26, 1988

Related U.S. Application Data

[63] Continuation-in-part of Ser. No. 476,370, Mar. 17, 1983, Pat. No. 4,747,447, which is a continuation-in-part of Ser. No. 339,858, Jan. 18, 1982, Pat. No. 4,521,674.

[51] Int. Cl.[4] ..... F24D 7/00

[52] U.S. Cl. ..... 165/48.1; 165/104.34; 237/15 L; 237/11

[58] Field of Search ..... 165/48.1, 104.34; 237/1 R, 15 L, 81, 11

[56] References Cited

U.S. PATENT DOCUMENTS 1,579,314 4/1926 Harrison ..... 237/81

3,246,634 4/1966 Stevens ..... 165/104.34

*Primary Examiner*—Albert W. Davis, Jr.

*Attorney, Agent, or Firm*—Brumbaugh, Graves, Donohue & Raymond

[57] ABSTRACT

A central space heating apparatus comprises a furnace having a chamber adapted to receive and contain a gas and a source a heat for heating the gas in the chamber, conduits connected in closed circuit to the furnace chamber for conducting the gas from the chamber and returning it to the chamber, helium gas filling the chamber and the conduit circuit under a pressure of from about 25 psig to about 100 psig at the operating temperature of the apparatus, a fan for circulating the helium gas through the conduit circuit and the furnace chamber, and a multiplicity of convector means connected in the conduit circuit for flow of the helium gas therethrough and installed at selected locations in the space to be heated for transferring heat from the flowing helium gas to the space.

5 Claims, 1 Drawing Sheet

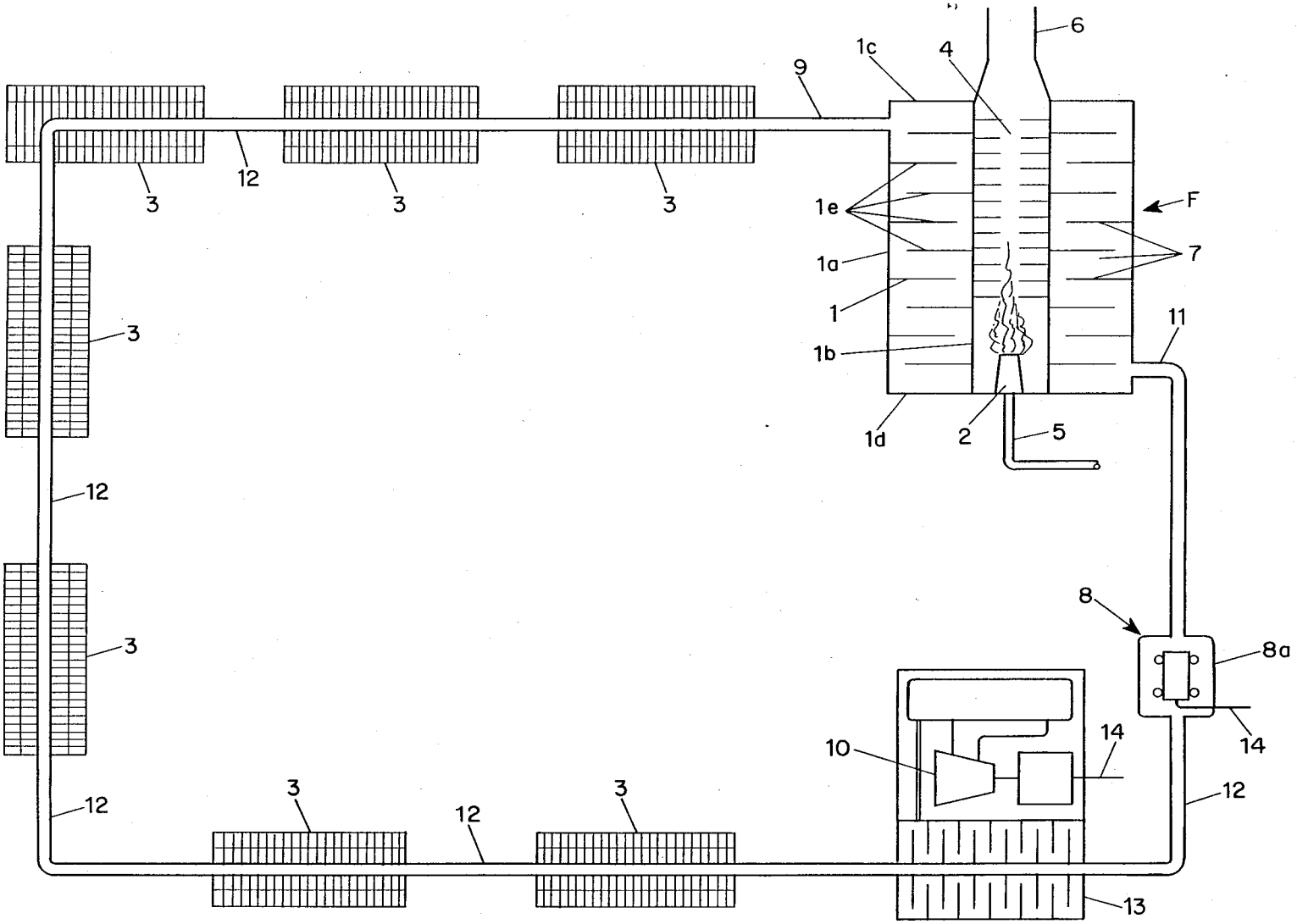
F
7
6
4
1c
9
1e
1a
1
1b
2
5
1d
11
8a
14
8
12
14
10
13
3
3
3
12
3
3
3
12
3
12

CENTRAL SPACE HEATING APPARATUS

This is a continuation-in-part of U.S. patent application Ser. No. 476,370 filed Mar. 17, 1983, now U.S. Pat. No. 4,747,447, granted May 31, 1988 which in turn is a continuation-in-part of U.S. patent application Ser. No. 339,858 filed Jan. 18, 1982, and now U.S. Pat. No. 4,521,674 granted June 4, 1985.

BACKGROUND OF THE INVENTION

The predominant ways of heating residential, commercial, and industrial space using a central heat source are few in number, comparatively old and very well-known. One way is to produce steam in a boiler, which is usually fired with a fossil fuel (gas, oil or coal), and distribute the steam through pipes to radiators located in selected places in the space. Central steam heating systems are no longer widely used in new construction, inasmuch as they are relatively costly to install, present maintenance problems due to scale buildup, are difficult to control effectively and require large, heavy and often unattractive radiators. A second way is to produce hot water in a furnace and pump it through convectors. As compared to steam systems, circulating hot water has the advantages of being of lower initial cost, presenting fewer maintenance problems, being easier to control (because of lower heat storage in the convectors), using generally smaller and less visually and physically intrusive convectors, and being compatible with air-cooling using the same convectors and the same piping or separate piping. A third way is to heat return air from the space in a furnace or a heat pump and circulate the heated air back to the space through ductwork. Forced air systems are relatively inexpensive to install but require comparatively large ducts to keep air velocities low and thereby minimize noise and reduce distribution losses due to highly turbulent air flow. Also, like circulating water systems forced air central heating may incorporate air-conditioning (air-cooling). Devices for air cleaning and humidification can readily be added to a forced air heating/cooling system.

While there have over the years been many improvements and new developments in various components of known central space heating systems, such as more efficient fuel burners and furnace heat exchangers, solar heat sources, heat pumps, and the like, the basic systems (steam, circulating hot water, and forced air) have existed without change in principle for perhaps a century or longer. Moreover, central heating is much more widely used than room heating, largely for economic reasons. Room-by-room heat pumps and baseboard electric heaters, the main devices for room heating, are more costly to operate and are, therefore, widely used only in residences in warmer climates and in vacation residences where heating is needed relatively infrequently.

SUMMARY OF THE INVENTION

The present invention is a new central space heating apparatus, which has the advantages of low initial cost, low operating cost, minimum space requirements, ease of installation, long life, and little need for maintenance. In particular, there is provided, in accordance with the present invention, a central space heating apparatus comprising a furnace having a chamber adapted to receive and contain a gas and a source of heat for heating the gas in the chamber, conduits connected in closed circuit to the furnace chamber for conducting the gas from the chamber and returning it to the chamber, helium gas filling the chamber and the conduit circuit under a pressure of from about 25 psig to about 100 psig at the operating temperature of the apparatus, a fan for circulating the helium gas through the conduit circuit and the furnace chamber, and a multiplicity of convectors connected in the conduit circuit for flow of the helium gas therethrough and installed at selected locations in the space to be heated for transferring heat from the flowing helium gas to the space.

In preferred embodiments, the furnace chamber is tubular and includes peripheral walls and thermally conducting internal walls, the internal walls defining a passage having an exhaust outlet, and the source of heat is a hot gas conducted from a burner through the passage and exhausted through the outlet. The furnace chamber preferably includes baffles extending transversely from the peripheral walls and from the internal walls partway across the tubular chamber and defining a tortuous path for the helium gas flowing through the chamber. It is also desirable to include fins extending partway into the passage from the internal walls for enhancement of heat transfer from the hot gases to the internal walls.

The high specific heat (about five times that of air) and high thermal conductivity (about six times that of air) of helium gas enable it to absorb heat in the furnace and give it up in the convectors very rapidly and effectively. Circulation of the helium gas through the conduit circuit, furnace and convectors requires less power than is required to circulate hot water for the same rate of heat output in a comparable system, inasmuch as the flow resistance of helium gas is much less than that of water.

Helium is an inert gas, which means that corrosion and scale buildup throughout the system, an inevitable problem in steam and circulating water systems, are non-existent. The helium gas heating system of the present invention will, therefore, last indefinitely without maintenance or repair and will be of undiminished efficiency over its lifetime. Periodic cleaning of the furnace combustion chamber and burner and the convectors, which is routine for such devices in all systems, will ensure reliable, efficient operation for many years. Similarly, the pump or fan for circulating the helium is not subject to cavitation or erosion and should last longer and cost less than a water pump.

When the system is shut down in cold weather, there is no danger of freezing, and consequent breakage of pipes or other elements. Leakage of the helium system for any reason causes no harm to the building, its fixtures and furnishings or its occupants—the helium gas is harmless and rapidly escapes.

Helium, like all gases, expands when heated. The system is designed to be filled with helium gas under an initial pressure at the ambient temperature at the time of filling such that when the system is operating at its designed output, the pressure is at a predetermined level which, as mentioned above, is between about 25 psig and about 100 psig. The design operating pressure is selected with the knowledge, on the one hand, that the higher the operating pressure is, the greater the specific heat will be and the lower will be the volumetric flow rate for a given heat output but that, on the other hand, the more rigorous will be the demands of strength and quality in all components to contain the more highly pressurized gas. In any case, the system affords two safety systems for shut down, one based on an over-temperature shutoff and the other on an over-pressure shutoff. Both systems can be backed up by a third, pressure relief by release of helium through a pressure-relief valve.

Most components of a circulating helium gas heating system, according to the present invention, can be generally comparable to those of a circulating hot water heating system. Small diameter copper piping with soldered or well-sealed mechanical couplings, copper convectors, and conventional oil or gas burners are suitable. Pipe and convector sizes may be comparable to those of hot water systems. The helium may be circulated with a relatively inexpensive, low-powered fan, which can easily be sealed within a leak-proof casing and coupled into the conduit circuit upstream from the furnace. The furnace chamber is simple to make and is, advantageously, free of coils, though it is within the scope of the invention to use a furnace having a heated plenum with finned coils through which the helium gas is conducted for heating. While the system requires no expansion and make- up tank, it is desirable to provide a small helium cannister to sustain the fill level in case of small leaks.

The system is well-suited to incorporation of an air-conditioning unit in series with the furnace, which permits changing over from heating to cooling by simply turning off the furnace and turning on the air conditioner unit. The air conditioner unit can, as is customary, be installed outside the building, but because the helium gas circulated through the cold-side heat exchanger of the unit does not freeze, there is no need for a parallel bypass conduit, or for a separate conduit circuit, or for winterizing the unit. Instead, the air-conditioning unit can remain in the circuit at all times. It is desirable to use a protective, insulating winter cover for the unit. With an in-series cooling feature, the system will also include convectors equipped with fans, as is known per se.

Perhaps the most important advantage of the present invention over conventional steam, circulating hot water and forced air heating is the remarkable ability of helium gas to receive and give up heat. Within the chamber of the furnace and the convectors, the helium gas, being highly fluid, circulates rapidly and mixes aggressively so that all gas quickly reaches a relatively uniform temperature upon heating or cooling - there are no hot spots or cold spots. The helium gas has no boundary layer like that of water to impede heat transfer. Its vastly greater fluidity produces convective currents far more effective than those formed in water in accepting and giving up heat from hotter or cooler surfaces in the furnace and convectors, respectively.

For a better understanding of the invention, reference may be made to the following description of an embodiment, taken in conjunction with the accompanying drawings.

DESCRIPTION OF THE DRAWING

The drawing is a diagram in generally schematic form of an embodiment.

DESCRIPTION OF THE EMBODIMENT

A furnace F, suitably located in or adjacent to the building that defines the space to be heated, comprises an annular chamber 1 formed by peripheral walls 1*a*, internal walls 1*b* and top and bottom walls 1*c* and 1*d*. Within the internal walls 1*b*, which are thermally conducting, is a passage 4 through which heated gases flow from combustion of a fuel, such as natural or propane gas or heating oil, in a burner 2 fed with the fuel through a pipe 5. The hot gases flow upwardly through the passage 4 to and out of an exhaust pipe 6. Baffles or fins 4*a* extending from the walls 1*b* partway into the chamber 1 enhance the transfer of heat from the hot gases to the internal wall 1*b* of the furnace chamber 1. For ease of construction, the furnace may be of circular cylindrical shape. Other designs for furnaces useful in the present invention may be based on those shown in U.S. Pat. No. 4,521,674 and U.S. patent application No. 476,370 (both referred to above); instead of having closed chambers for the helium gas, providing heat transfer by natural convection and incorporating heat transfer to another fluid, an inlet and an outlet, like those described below, are provided for the helium chamber, which is part of a closed-circuit loop for circulation of the helium gas, to make those devices suitable for use as furnaces in the present invention. Generally, a gas or oil furnace will be more economical to operate than an electric furnace, and the use of an electrical heat source for the furnace will ordinarily be limited to areas where cheap electrical power is available.

An outlet conduit 9 leads from the top of the furnace chamber 1 to a series of convectors 3 and intermediate conduits 12 connecting the convectors. The convectors 3 are, of course, suitably located in the space to be heated, which may be (and usually will be) subdivided into rooms (not shown). The conduits and convectors may be the same as those used in circulating hot water heating systems, copper tubing with soldered couplings and joints or well-sealed mechanical couplings and joints being preferred.

An optional, but often desirable, part of a system, according to the invention, is a conventional air conditioner unit 10. The cold-side heat exchanger 13 of the air conditioner unit 10 is connected in series with the furnace F. Conversion of the system from the heating to the cooling mode requires merely turning off the furnace and turning on the air conditioner unit.

The conduit/convector circuit leads back to the furnace through an inlet conduit 11 connected to the bottom of the furnace chamber 1. A small centrifugal fan 8 is interposed in the circuit downstream of the last convector and upstream from the inlet conduit 11. The fan 8 is sealed within a casing 8*a* which is easy to do since only its electrical leads 14 pass out of the casing.

The furnace chamber 1, conduits 9, 12, 11 and convectors 3 form a closed circuit. After the system is installed and the circuit tested for gas tightness using compressed air, it is filled with helium gas under a pressure at the ambient temperature at the time of filling such that when it is at the design operating temperature, the helium gas will be under the pressure at which the system is designed to operate. As discussed above, the operating pressure is preferably in the range of from about 25 psig to 100 psig.

The outside walls 1*a* 1*c* and 1*d* of the furnace should, of course, be well insulated. It is also desirable for the conduits to be insulated. Baffles 1*e* extend from the furnace chamber walls 1*a* and 1*b* to create a tortuous path for the flow of the helium gas through the chamber 1 to increase the residence time of the helium in the chamber, promote mixing of hotter and cooler gases and prevent short circuit direct flow paths from the inlet to the outlet. The baffles 1*e* that extend from the internal wall 1*b* should be thermally conducting so that they receive heat by conduction from the internal walls 1*b* and thence transfer it to the helium gas.

The fan 8 circulates the helium gas at a rate sufficient to distribute the heat among the convectors. It is well within the ordinary skill of the art to design the system to produce selected temperature drops seriatum between the convectors 3 and to size the convectors to give up amounts of heat to meet the requirements of the space being heated. Because of the low resistance to flow of the helium gas through the circuit, the fan will be of somewhat lower power than a pump for a comparable circulating hot water heating system.

In the embodiment, the helium gas flows through the furnace chamber in the same direction as the combustion gases flow through the combustion chamber; it is entirely suitable, and may be advantageous as well, for the helium gas and hot combustion gases to flow in opposite directions through the furnace.

We claim:

1. A central space heating apparatus comprising a furnace having a chamber adapted to receive and contain a gas and a source of heat for heating the gas in the chamber, conduit means connected in closed circuit to the furnace chamber for conducting the gas from the chamber and returning it to the chamber, helium gas filling the chamber and the conduit circuit under a pressure of from about 25 psig to about 100 psig at the operating temperature of the apparatus, means for circulating the helium gas through the conduit circuit and the furnace chamber, and a multiplicity of convector means connected in the conduit circuit for flow of the helium gas therethrough and installed at selected locations in the space to be heated for transferring heat from the flowing helium gas to the space to be heated.

2. Apparatus according to claim 1 wherein the furnace chamber is tubular and includes peripheral walls and thermally conducting internal walls, the internal walls defining a passage having an exhaust outlet, and wherein the source of heat is a hot gas conducted from a burner through the passage and exhausted through the outlet.

3. Apparatus according to claim 2 wherein the furnace chamber includes baffles extending transversely from the peripheral walls and from the internal walls partway across the chamber and defining a tortuous flow path for the helium gas flowing through the chamber.

4. Apparatus according to claim 3 wherein fins extend partway into the passage from the internal walls for enhancement of heat transfer from the hot gas to the internal walls.

5. Apparatus according to claim 1 and further comprising means interposed in the conduit circuit for removing heat from the helium gas and for discharging the removed heat externally of the space, whereby the apparatus is adapted to cool the space.

* * * * *